US011857041B2

(12) United States Patent
Wu et al.

(10) Patent No.: US 11,857,041 B2
(45) Date of Patent: Jan. 2, 2024

(54) SPECIAL-SHAPED FOLDING UMBRELLA

(71) Applicants: Chyi-Fong Wu, New Taipei (TW); Chi-Hua Wu, New Taipei (TW)

(72) Inventors: Tsun-Zong Wu, New Taipei (TW); Hsien-Jung Chen, New Taipei (TW)

(73) Assignees: Chyi-Fong Wu, New Taipei (TW); Chi-Hua Wu, New Taipei (TW)

( * ) Notice: Subject to any disclaimer, the term of this patent is extended or adjusted under 35 U.S.C. 154(b) by 142 days.

(21) Appl. No.: 17/576,518

(22) Filed: Jan. 14, 2022

(65) Prior Publication Data

US 2022/0369773 A1 Nov. 24, 2022

(30) Foreign Application Priority Data

May 19, 2021 (TW) ..... 110205740

(51) Int. Cl.
*A45B 19/10* (2006.01)
*A45B 25/18* (2006.01)
*A45B 11/00* (2006.01)

(52) U.S. Cl.
CPC ..... *A45B 19/10* (2013.01); *A45B 11/00* (2013.01); *A45B 25/18* (2013.01); *A45B 2011/005* (2013.01)

(58) Field of Classification Search
CPC .... A45B 19/10; A45B 11/00; A45B 2011/005
See application file for complete search history.

(56) References Cited

U.S. PATENT DOCUMENTS 4,474,200 A * 10/1984 Kida ..... A45B 25/02 135/20.1
4,474,201 A * 10/1984 Kida ..... A45B 19/06 135/20.1
5,505,221 A * 4/1996 Gao ..... A45B 11/00 135/20.1
D599,103 S 9/2009 Hoogendoorn et al.
7,610,925 B2 * 11/2009 Parisi ..... A45B 25/143 135/31
7,665,476 B2 * 2/2010 Lisciandro ..... A45B 11/00 135/20.1
D618,899 S 7/2010 Hoogendoorn et al.
(Continued)

FOREIGN PATENT DOCUMENTS

CN 201602246 U 10/2010
CN 201668060 U 12/2010
(Continued)

*Primary Examiner* — Noah Chandler Hawk
(74) *Attorney, Agent, or Firm* — Muncy, Geissler, Olds & Lowe, P.C.

(57) ABSTRACT

A special-shaped folding umbrella which includes a plurality of 3-fold ribs and a plurality of 4-fold ribs is revealed. When the umbrella is closed, a height of a first connecting point of the 3-fold rib and that of a first connecting point of the 4-fold rib are quite similar (almost the same). A height of a sixth connecting point of the 3-fold rib is at similar to that of a seventh connecting point of the 4-fold rib. A third connecting point of the 3-fold rib and a fourth connecting point of the 4-fold rib are at similar height and so are a fourth connecting point of the 3-fold rib and a fifth connecting point of the 4-fold rib. A tip of the 3-fold rib and a tip of the 4-fold rib are maintained at similar level while the umbrella is closed.

9 Claims, 14 Drawing Sheets

(56) References Cited

U.S. PATENT DOCUMENTS

| | | | | |
|---|---|---|---|---|
| D677,046 | S | 3/2013 | Hoogendoorn | |
| 2008/0149152 | A1* | 6/2008 | Huang | A45B 19/10 135/20.1 |
| 2009/0126769 | A1 | 5/2009 | Hoogendoorn | |
| 2009/0308419 | A1* | 12/2009 | You | A45B 25/02 135/20.1 |

FOREIGN PATENT DOCUMENTS

| | | | |
|---|---|---|---|
| CN | 202664494 | U | 1/2013 |
| CN | 103284424 | B | 9/2013 |
| JP | 2020192097 | A | 12/2020 |

* cited by examiner

SPECIAL-SHAPED FOLDING UMBRELLA

BACKGROUND OF THE INVENTION

The present invention relates to a folding umbrella, especially to a special-shaped folding umbrella easy to be folded and closed.

Generally, umbrellas available now are divided into an umbrella for a single user with a smaller canopy and an umbrella for two users with a larger canopy. Inner ends of ribs are connected to a central shaft of the umbrella while outer ends of the ribs are extended radially from the central shaft of the umbrella. A fabric with certain area is fitted over the ribs to form the canopy. The canopy of the umbrella is circular in shape and sometimes unable to cover the user's body completely. For example, the user's shoulder or backpack is exposed and the umbrella is unable to protect the user from getting wet. Thus users have bad experiences with the umbrella. In order to solve the above problem, a special-shaped folding umbrella is available on the market such as those revealed in JP 2020192097 A, US 2009/0126769 A1, US D618,899 S, US D677,046 S, and US D599,103 S.

However, a tip on an outer (distal) end of respective 3-fold ribs to which a canopy is attached and a tip on an outer (distal) end of respective 4-fold ribs to which a canopy is attached are not at the same level while the folding umbrella being folded (closed), as shown in FIG. 5 and FIG. 6 of JP 2020192097 A. Thereby the folding and closing of the umbrella are not convenient for users. As to a canopy device revealed in US 2009/0126769 A1, it's different from a folding umbrella while in use. Refer to US D618,899 S, a parasol revealed is not a folding umbrella and the state of the ribs during the closing is not disclosed. Refer to US D599,103 S, the state of the ribs during the closing is not disclosed. Moreover, most of the special-shaped folding umbrellas available now have problems of a more complicated structure and higher manufacturing cost.

SUMMARY OF THE INVENTION

Therefore, it is a primary object of the present invention to provide a special-shaped folding umbrella which is not only easy to be folded and closed but also having lower manufacturing cost due to simple structure.

In order to achieve the above object, a special-shaped folding umbrella according to the present invention includes a shaft, a cap, a runner, a notch, a plurality of 3-fold ribs, and a plurality of 4-fold ribs. While the umbrella is in a folded and closed state, a first connecting point of the respective 3-fold ribs and a first connecting point of the respective 4-fold ribs are at quite similar level (almost the same level). A height of a six connecting point of the respective 3-fold ribs and a height of a seventh connecting point of the respective 4-fold ribs are similar to each other and so are a height of a third connecting point of the respective 3-fold ribs and a height of a fourth connecting point of the respective 4-fold ribs. A level of a fourth connecting point of the respective 3-fold ribs and a level of a fifth connecting point of the respective 4-fold ribs are also similar During the folded and closed state, a tip of each of the 3-fold ribs and a tip of each of the 4-fold ribs are maintained at quite similar (nearly the same) level. Thereby the problems of the special-shaped umbrella available now such as difficulty in folding and closing and high manufacturing cost can be solved.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 2:
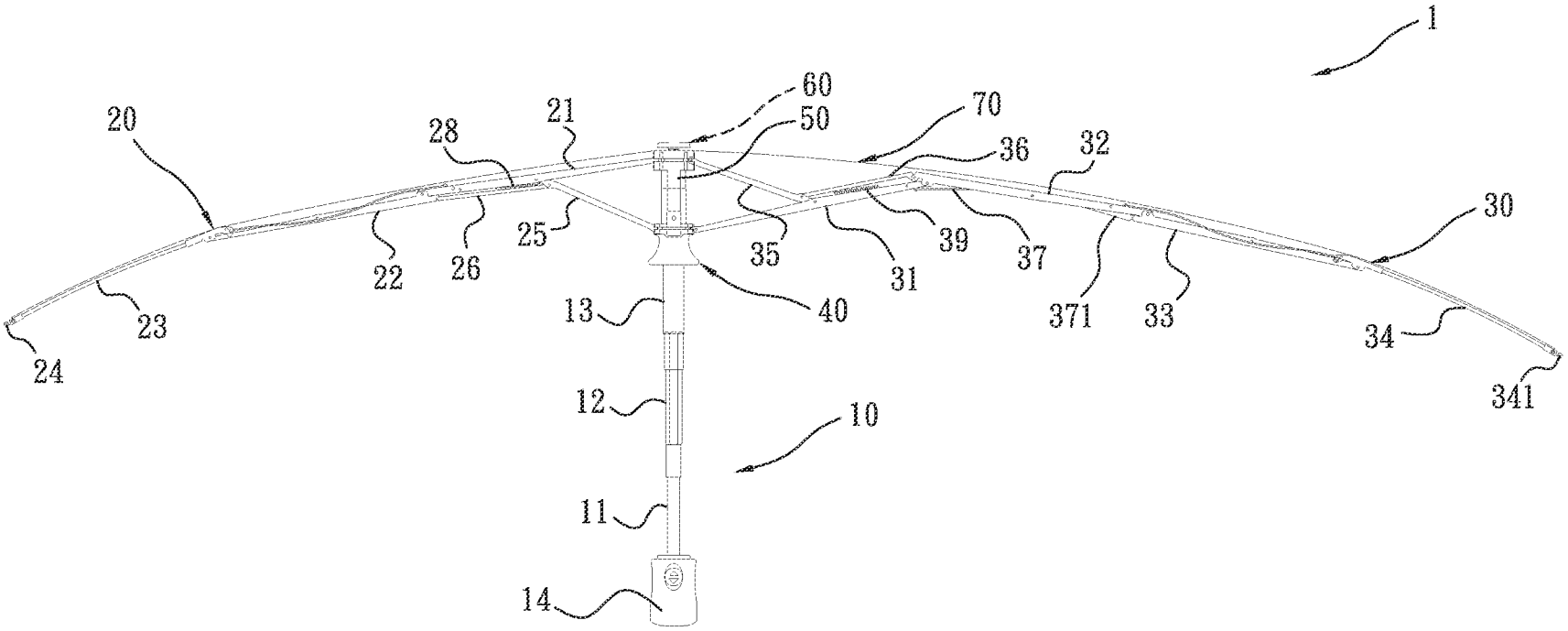
FIG. 2 is a schematic drawing showing a side view of an embodiment of a special-shaped folding umbrella in an open state according to the present invention.
Figure 6:
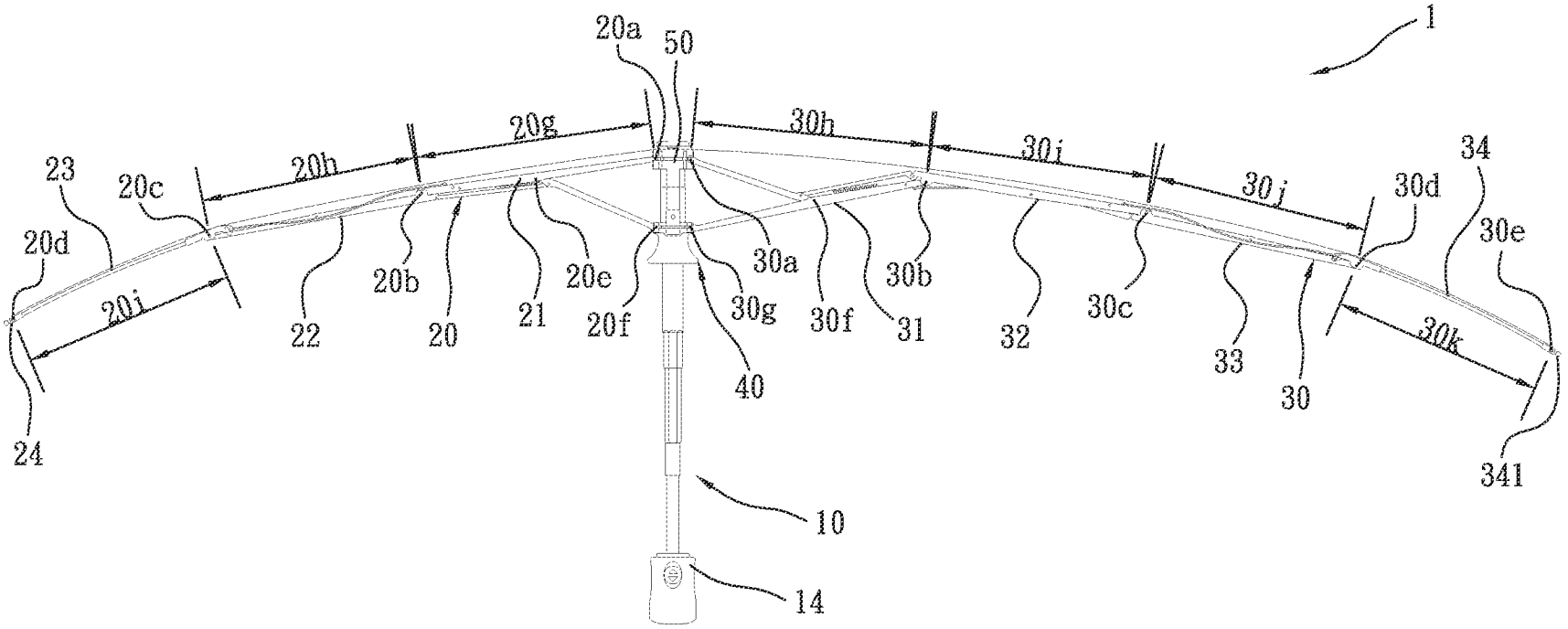
FIG. 6 is a schematic drawing showing a ratio of a length of a 3-fold rib to a length of a 4-fold rib of the embodiment in FIG. 2 according to the present invention.

A folded and closed state mentioned hereafter means users pull a folding umbrella originally in an opened state (as shown in FIG. 2 and FIG. 6) down and then close a strap or place the folded umbrella into an umbrella pocket so that the folding umbrella is maintained at the folded and closed state for easy storage (not shown in figure).

Refer to FIG. 2, a special-shaped folding umbrella 1 according to the present invention includes a shaft 10, a plurality of 3-fold ribs 20, a plurality of 4-fold ribs 30, a runner 40, a notch 50, and a cap 60.

Figure 1:
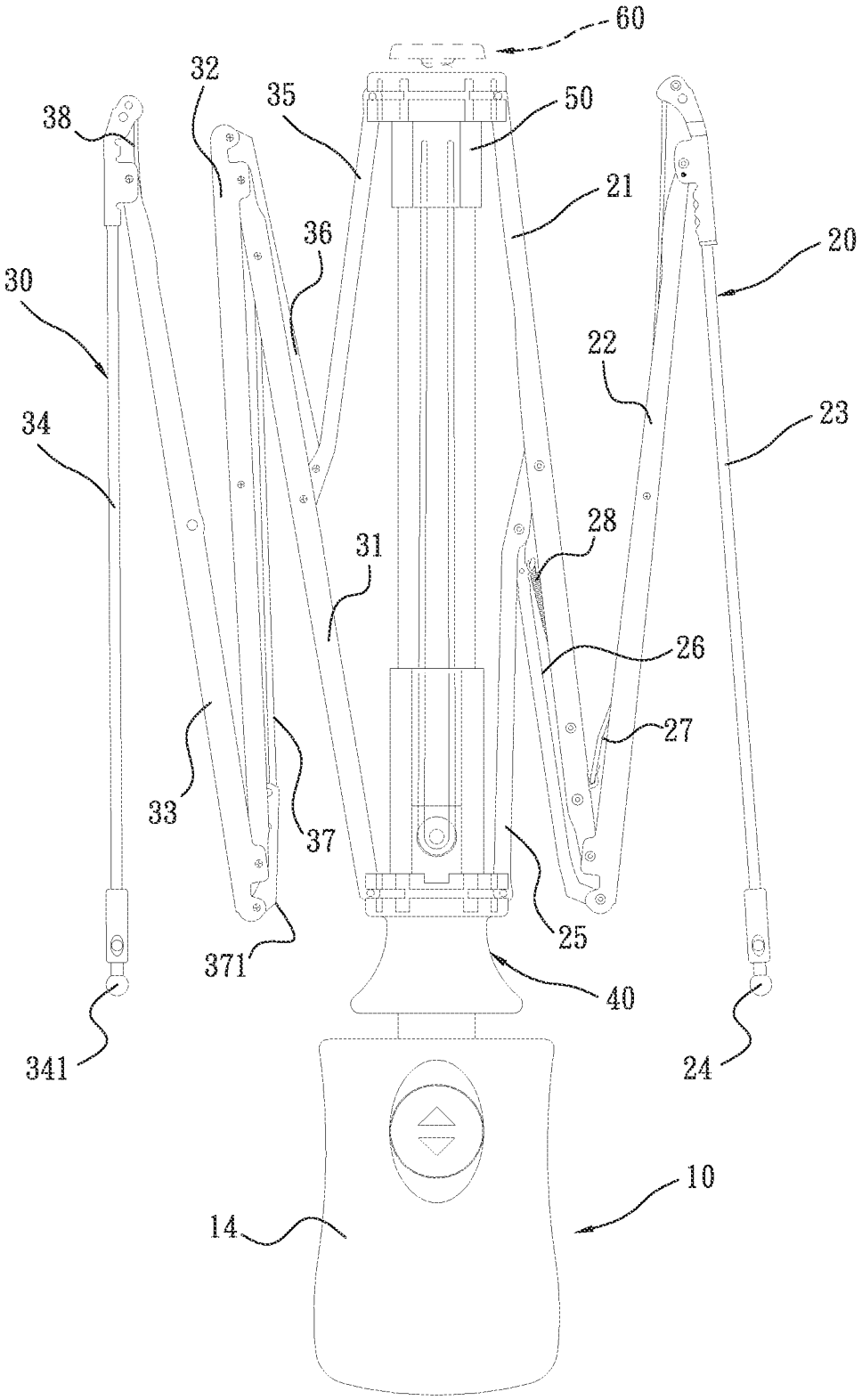
FIG. 1 is a schematic drawing showing a side view of an embodiment of a special-shaped folding umbrella (without a special-shaped canopy) in a folded and closed state according to the present invention.

Refer to FIG. 1 and FIG. 2, the shaft 10 is located close to a center of the special-shaped folding umbrella 1 and a head 14 is formed on a bottom of the shaft 10. The shaft 10 which can be, but not limited to be retractable consists of an inner tube 11, a middle tube 12, and an outer tube 13, as shown in FIG. 2. The inner tube 11 is able to be mounted into the middle tube 12 which is able to be mounted into the outer tube 13 so that the present device is applied to the field of the folding umbrella which is much easier to be folded and stored than handheld non-folding special-shaped umbrellas available now such as those revealed in US 2009/0126769 A1 and US D677,046 S. Opposite to the head 14, the cap 60 is located on a top of the shaft 10. The notch 50 is also disposed on the top of the shaft 10 and arranged under the cap 60. Both the notch 50 and the cap 60 are but not limited to: fixed on a top of the outer tube 13, but not limited. The runner 40 is moveably arranged between the head 14 and able to be (but not limited) moved along the outer tube 13.

Figure 3:
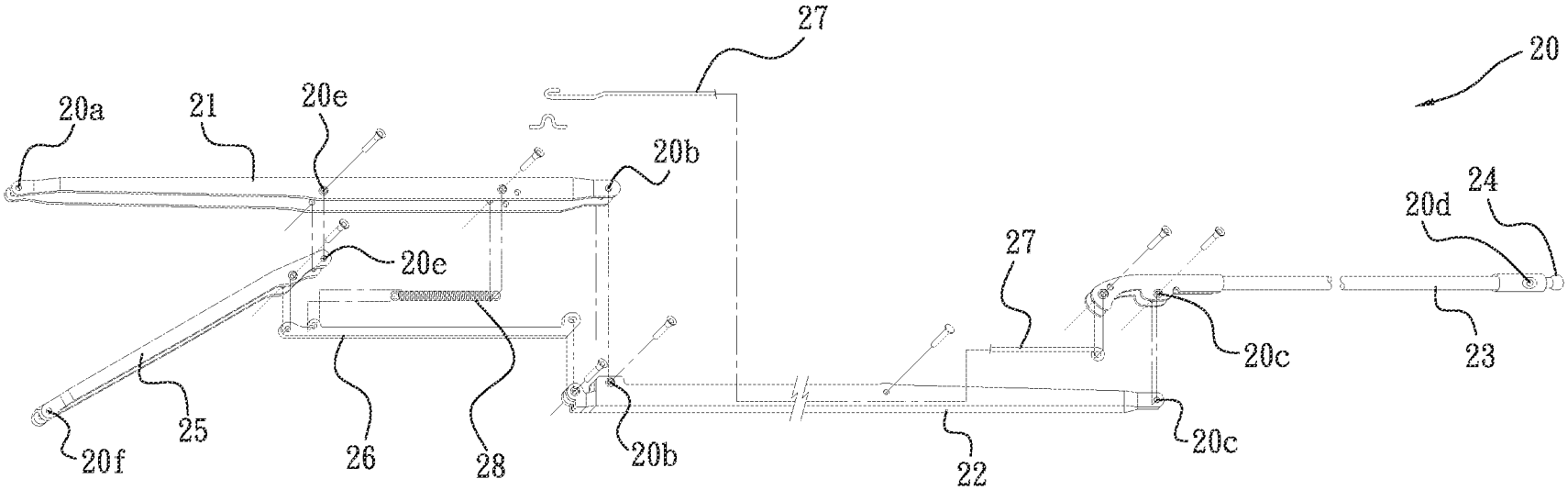
FIG. 3 is an exploded view of a 3-fold rib of an embodiment according to the present invention.
Figure 3A:
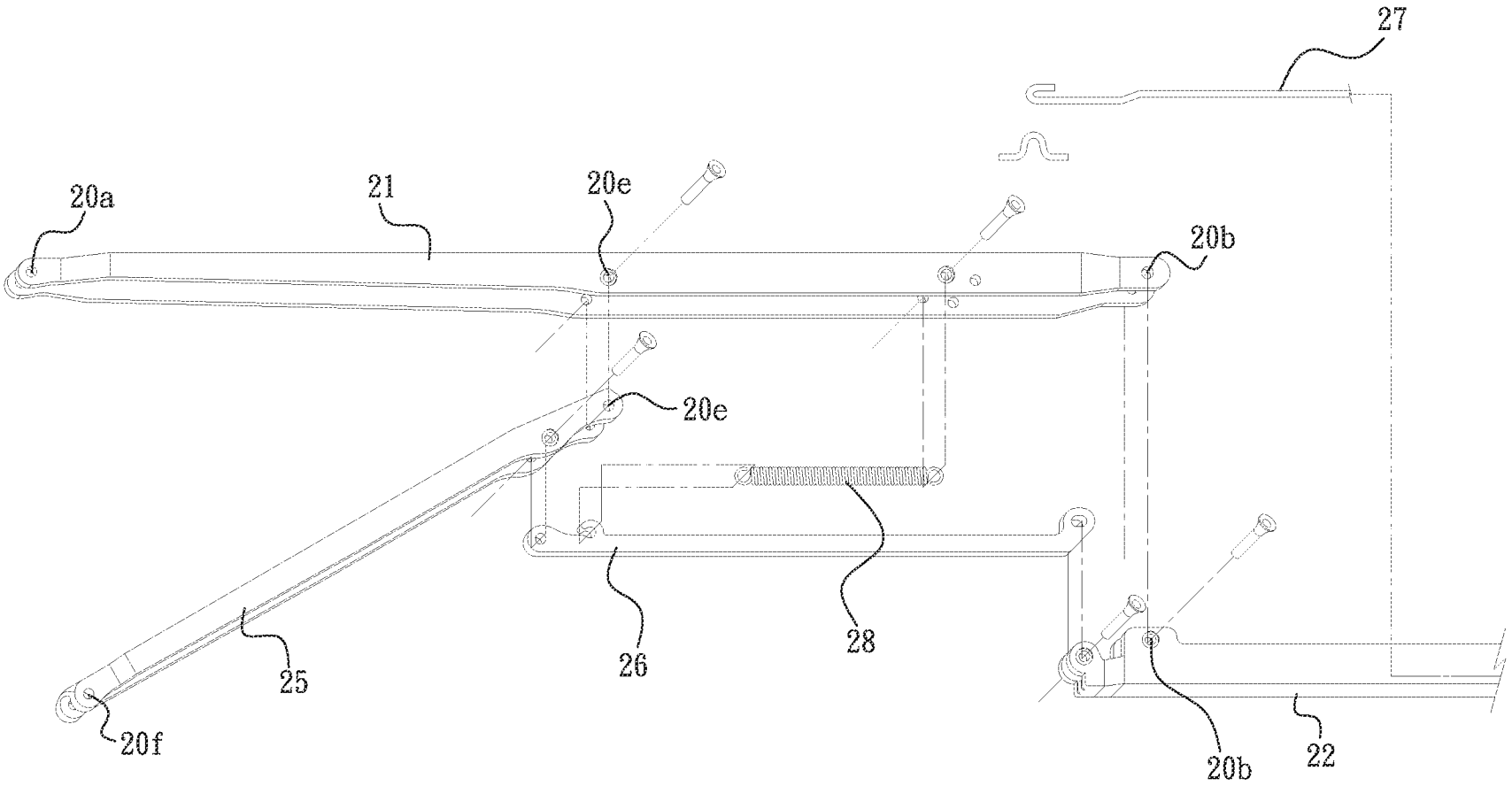
FIG. 3*a* is a partial exploded view of a left half of the embodiment in FIG. 3 according to the present invention.
Figure 3B:
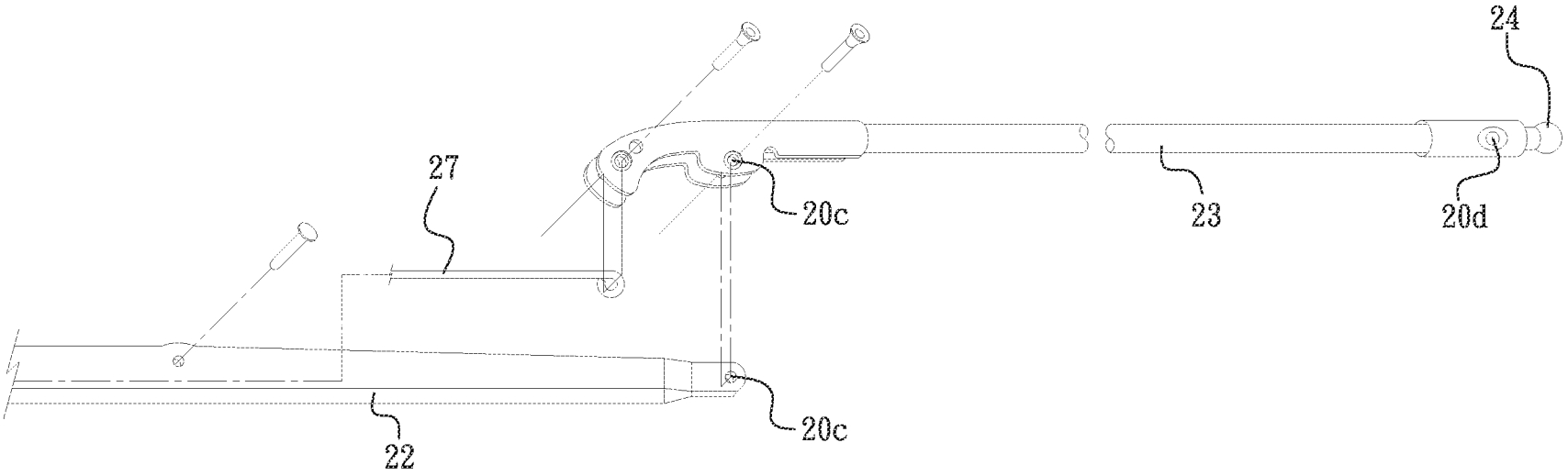
FIG. 3*b* is a partial exploded view of a right half of the embodiment in FIG. 3 according to the present invention.
Figure 7:
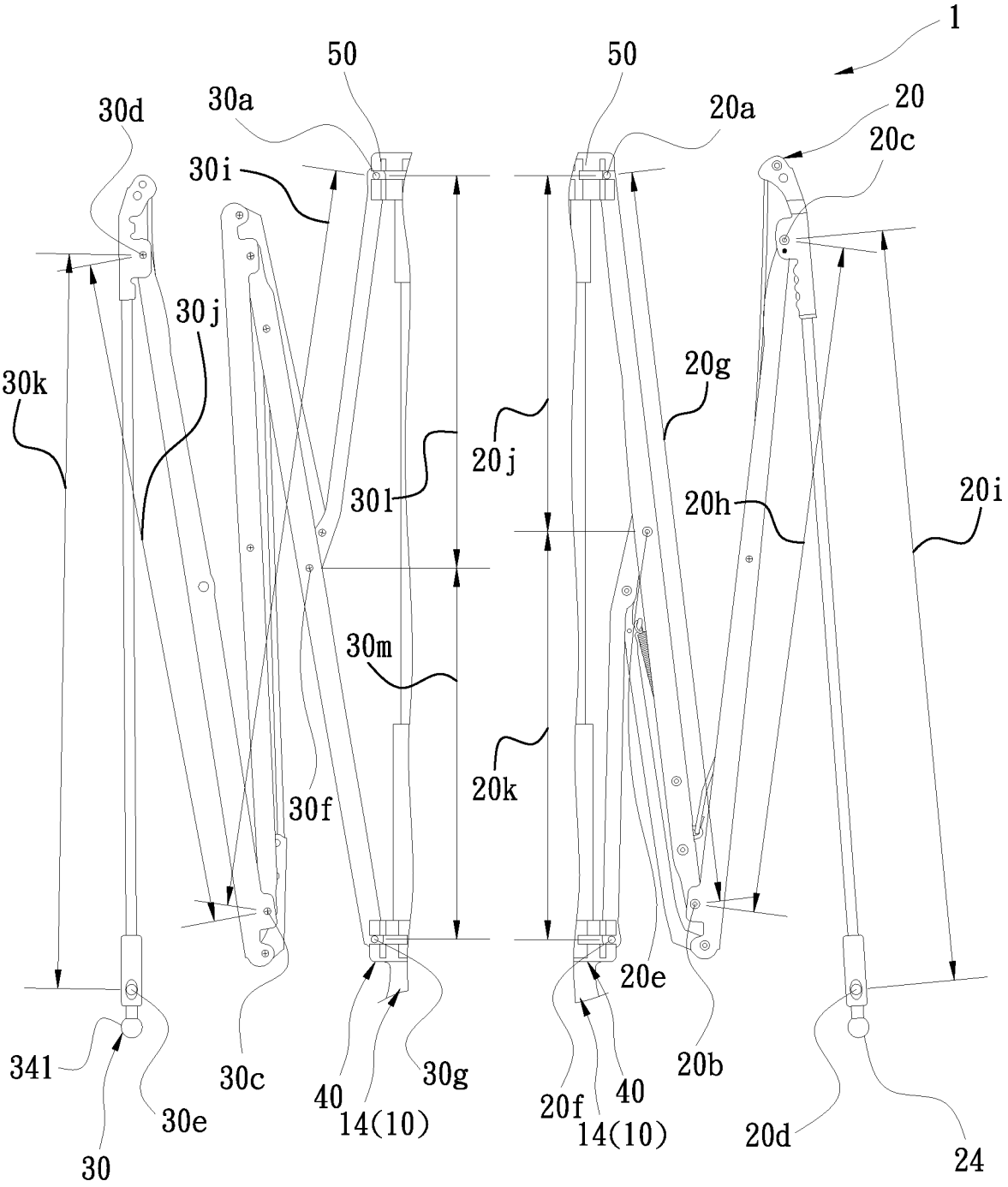
FIG. 7 is a schematic drawing showing a ratio of a length of a 3-fold rib to a length of a 4-fold rib of the embodiment in FIG. 1 according to the present invention.

Refer to FIG. 1-3*b*, FIG. 6, and FIG. 7, the respective 3-fold ribs 20 are disposed between the runner 40 and the notch 50 and able to be opened (as shown in FIG. 2 and FIG. 6) or closed (as shown in FIG. 1 and FIG. 7). The respective 3-fold ribs 20 are moved along with the runner 40 and having an inner side close to the shaft 10 and an outer (distal) side provided with a tip 24. The 3-fold rib 20 is composed of a first inner main rib 21 having one end moveably connected to the notch 50, a first middle main rib 22 having one end moveably connected to the other end of the first inner main rib 21 by a rivet, a first outer cylindrical rib 23 having one end moveably connected to the other end of the first middle main rib 22 by a rivet, and the tip 24 connected to the other end of the first outer cylindrical rib 23, as shown in FIG. 2 and FIG. 3. The 3-fold rib 20 further includes a first branched rib 25 having one end moveably connected to the runner 40 and the other end moveably connected to a middle part of the first inner main rib 21 by a rivet, a first inner connecting rib 26 having one end moveably connected to the first branched rib 25 and the other end moveably connected to the first middle main rib 22, and a first middle connecting rib 27 connected to an outer side of the first inner main rib 21 by a hook. The first middle connecting rib 27 is inserted into the first middle main rib 22 at the position close to an inner side of the first middle main rib 22, passed through a part of the first middle main rib 22, and then penetrated out of the first middle main rib 22 at the position close to an outer side of the first middle main rib 22 to be moveably connected to the first outer cylindrical rib 23. The hook on the first inner main rib 21 is provided with and connected to one end of a first spring 28 while the other end of the first spring 28 is connected to the first inner connecting rib 26 by a lock 卡扣 on one side of the first inner connecting rib 26. As shown in FIG. 3 and FIG. 6, where the first inner main rib 21 is connected to the notch 50 is a first connecting point 20*a*, where the first inner main rib 21 and the first middle main rib 22 are connected is a second connecting point 20*b*, and where the first middle main rib 22 and the first outer cylindrical rib 23 are connected is a third connecting point 20*c*. Where the first outer cylindrical rib 23 and the tip 24 are connected is a fourth connecting point 20*d*, where the first branched rib 25 and the middle part of the first inner main rib 21 are connected is a fifth connecting point 20*e*, and where the first branched rib 25 is connected to the runner 40 is a sixth connecting point 20*f*, as shown in FIG. 3 and FIG. 6. When the respective 3-fold ribs 20 are opened, each of the 3-fold ribs 20 is composed of a first segment 20*g*, a second segment 20*h*, and a third segment 20*i* arranged from the inner side to the outer side of the 3-fold rib 20, as shown in FIG. 6. A length of the first segment 20*g*, a length of the second segment 20*h*, and a length of the third segment 20*i* are respectively a distance between the first connecting point 20*a* and the second connecting point 20*b*, a distance between the second connecting point 20*b* and the third connecting point 20*c*, and a distance between the third connecting point 20*c* and the fourth connecting point 20*d*, as shown in FIG. 6. The length of the first segment 20*g*, the length of the second segment 20*h*, and the length of the third segment 20*i* are quite similar to (approximately equal to) one another. While the respective 3-fold ribs 20 are folded and closed, each of the 3-fold ribs 20 further includes a fourth segment 20*j* and a fifth segment 20*k* from the inner side to the outer side thereof, as shown in FIG. 7. A length of the fourth segment 20*j* and a length of the fifth segment 20*k* are respectively a distance between the first connecting point 20*a* and the fifth connecting point 20*e* and a distance between the fifth connecting point 20*e* and the six connecting point 20*f*, as shown in FIG. 7. The first middle connecting rib 27 can be, but not limited to, an elastic deformable cylinder.

Figure 4:
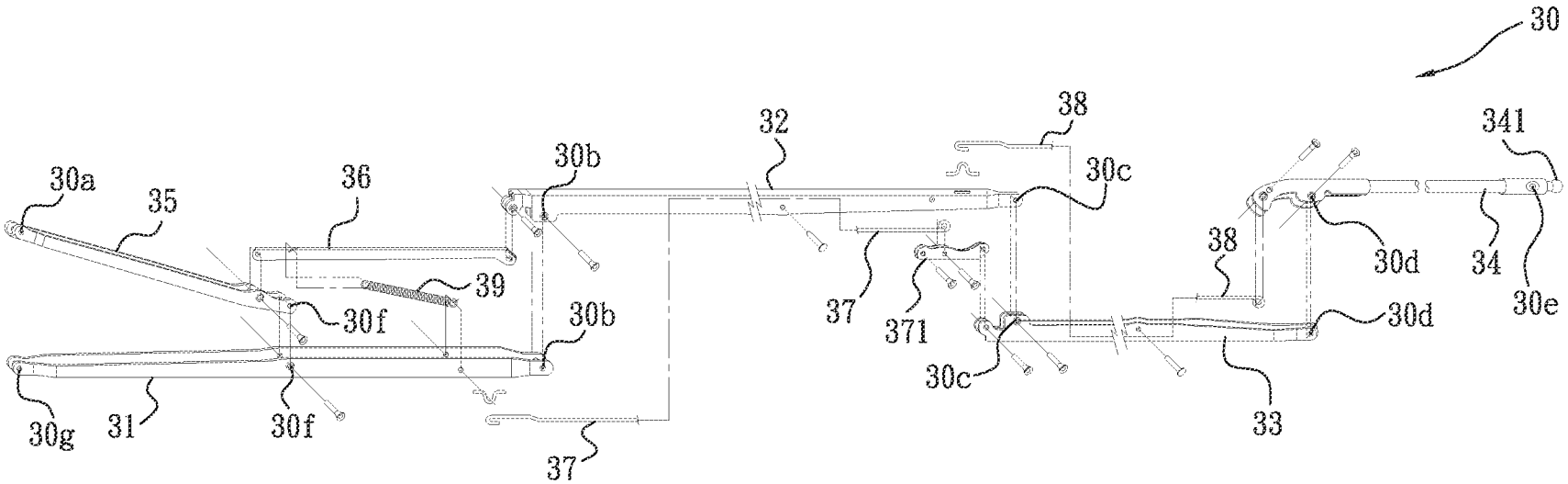
FIG. 4 is an exploded view of a 4-fold rib of an embodiment according to the present invention.
Figure 4A:
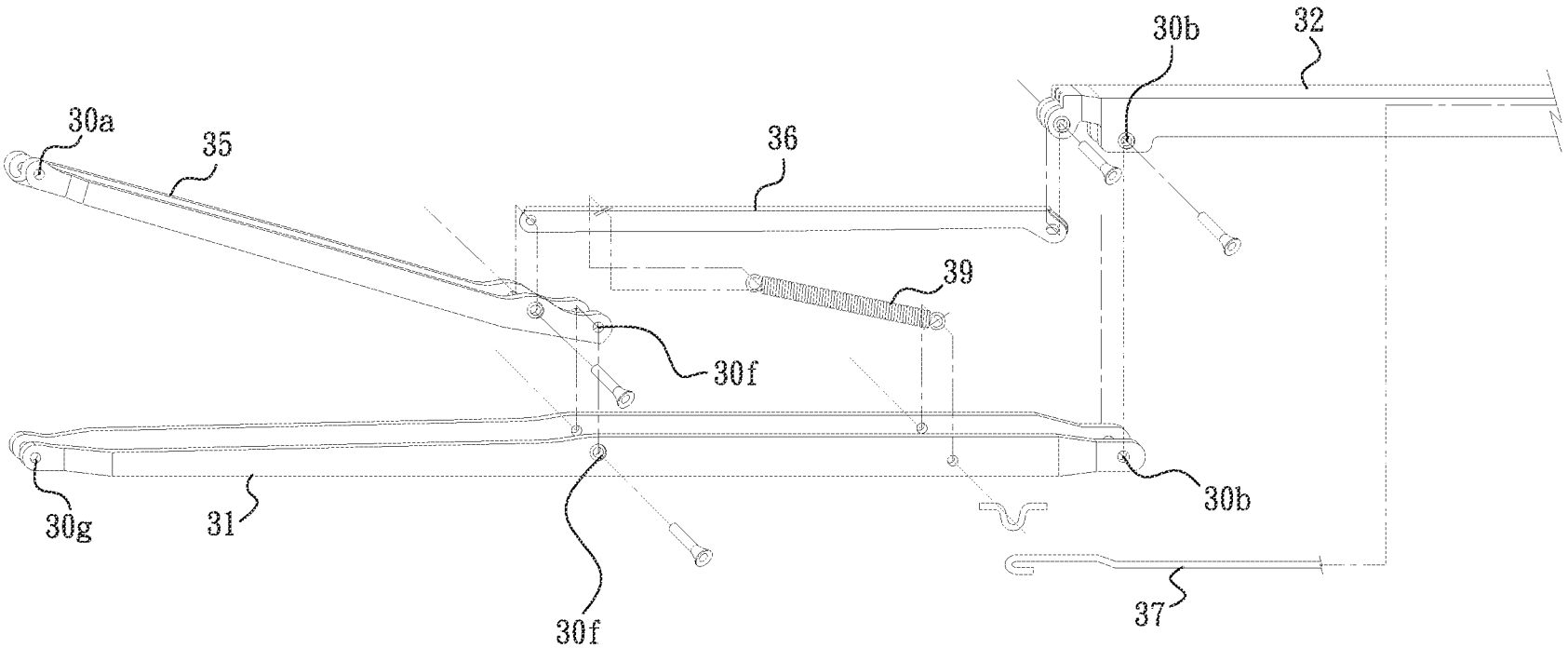
FIG. 4*a* is a partial exploded view of a left half of the embodiment in FIG. 4 according to the present invention.
Figure 4B:
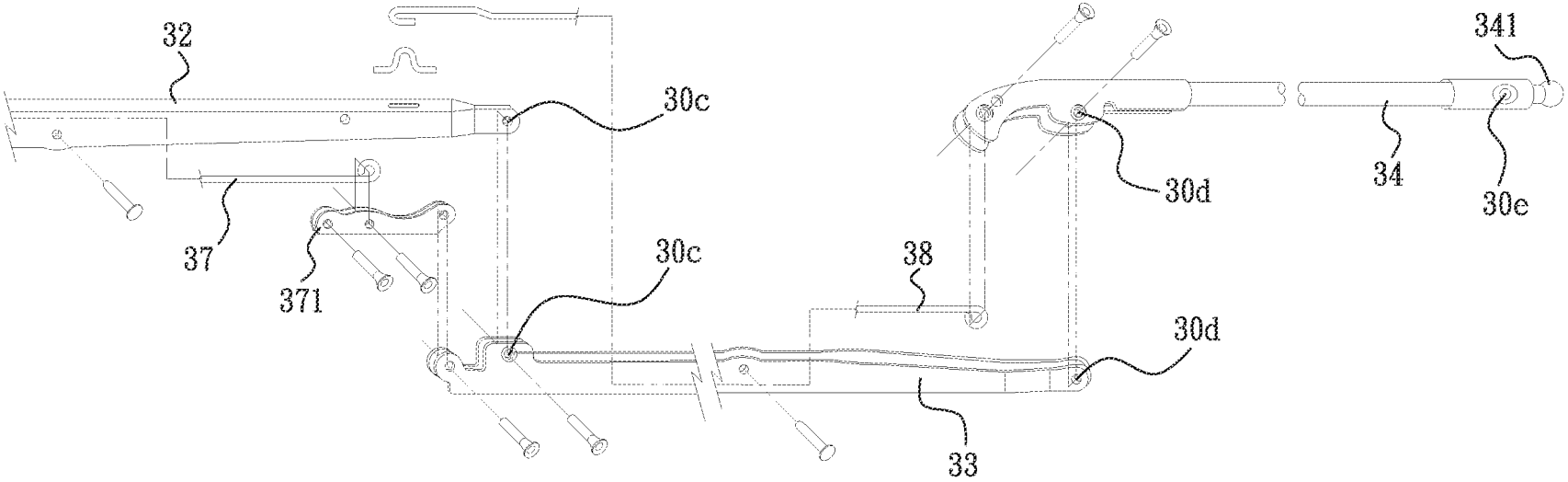
FIG. 4*b* is a partial exploded view of a right half of the embodiment in FIG. 4 according to the present invention.

Refer to FIG. 1, FIG. 2, FIG. 4-4*b*, FIG. 6, and FIG. 7, the respective 4-fold ribs 30 are arranged between the runner 40 and the notch 50 and able to be opened (as shown in FIG. 2 and FIG. 6) or closed (as shown in FIG. 1 and FIG. 7). The respective 4-fold ribs 30 are moved along with the runner 40 and having an inner side close to the shaft 10 and an outer (distal) side provided with a tip 341, as shown in FIG. 2 and FIG. 4. The 4-fold rib 30 consists of a second inner main rib 31 having one end moveably connected to the runner 40, a second middle main rib 32 having one end moveably connected to the other end of the second inner main rib 31 by a rivet, an outer main rib 33 having one end moveably connected to the other end of the second middle main rib 32 by a rivet, and a second outer cylindrical rib 34 moveably connected to the other end of the outer main rib 33 by a rivet, and the tip 341 arranged at the other end of the second outer cylindrical rib 34. The 4-fold rib 30 further includes a second branched rib 35 having one end moveably connected to the notch 50 and the other end moveably connected to a middle part of the second inner main rib 31 by a rivet, a second inner connecting rib 36 having one end moveably connected to an upper side of the second branched rib 35 by a rivet and the other end fixed and connected to the second middle main rib 32 by a rivet, and a second middle connecting rib 37 having one end connected to a lower side of the second inner main rib 31 by a hook and the other end fixed on one side of the outer main rib 33 close to the second middle main rib 32. As shown in FIG. 4 and FIG. 4*b*, a middle part of the second middle main rib 32 is provided with a limit pin which limits the second middle connecting rib 37 in the second middle main rib 32 while an outer side of the e second middle main rib 32 is connected to one end of an outer connecting rib 38 by a hook and the other end of the outer connecting rib 38 is moveably connected to one side of the second outer cylindrical rib 34 close to the outer main rib 33 by a rivet. A middle part of the outer main rib 33 is provided with a limit pin which limits the outer connecting rib 38 in the outer main rib 33. One end of the second inner connecting rib 36 close to the second branched rib 35 is provided with a second spring 39 which is fixed on the hook of the second middle connecting rib 37. As shown in FIG. 4 and FIG. 6, where the second branched rib 35 is connected to the notch 50 is a first connecting point 30*a*, where the second inner main rib 31 and the second middle main rib 32 are connected is a second connecting point 30*b*, and where the second middle main rib 32 and the outer main rib 33 are connected is a third connecting point 30*c*. Where the outer main rib 33 and the second outer cylindrical rib 34 are connected is a fourth connecting point 30*d*, where the second outer cylindrical rib 34 and the tip 341 are connected is a fifth connecting point 30*e*, as shown in FIG. 4 and FIG. 6. Where the second branched rib 35 and a middle part of the second inner main rib 31 are connected is a sixth connecting point 30*f* and where the second inner main rib 31 is connected to the runner 40 is a seventh connecting point 30*g*, as shown in FIG. 4 and FIG. 6. When the respective 4-fold ribs 30 are opened, each of the respective 4-fold ribs 30 includes a first segment 30*h*, a second segment 30*i*, a third segment 30*j*, and a fourth segment 30*k* disposed from an inside to an outer side thereof, as shown in FIG. 6. A length of the first segment 30*h*, a length of the second segment 30*i*, a length of the third segment 30*j*, and a length of the fourth segment 30*k* are respectively a distance between the first connecting point 30*a* and the second connecting point 30*b*, a distance between the second connecting point 30*b* and the third connecting point 30*c*, a distance between the third connecting point 30*c* and the fourth connecting point 30*d*, and a distance between the fourth connecting point 30*d* and the fifth connecting point 30*e* as shown in FIG. 6. The length of the first segment 30*h*, the length of the second segment 30*i*, the length of the third segment 30*j*, and the length of the fourth segment 30*k* are quite similar to (approximately equal to) one another. While the respective 4-fold ribs 30 are folded and closed, each of the 4-fold ribs 30 includes a fifth segment 30*l* and a sixth segment 30*m* from the inner side to the outer side thereof, as shown in FIG. 7. A length of the fifth segment 30*l* and a length of the sixth segment 30*m* are respectively a distance between the first connecting point 30*a* and the six connecting point 30*f* and a distance between the six connecting point 30*f* and the seventh connecting point 30*g*, as shown in FIG. 7.

Figure 5:
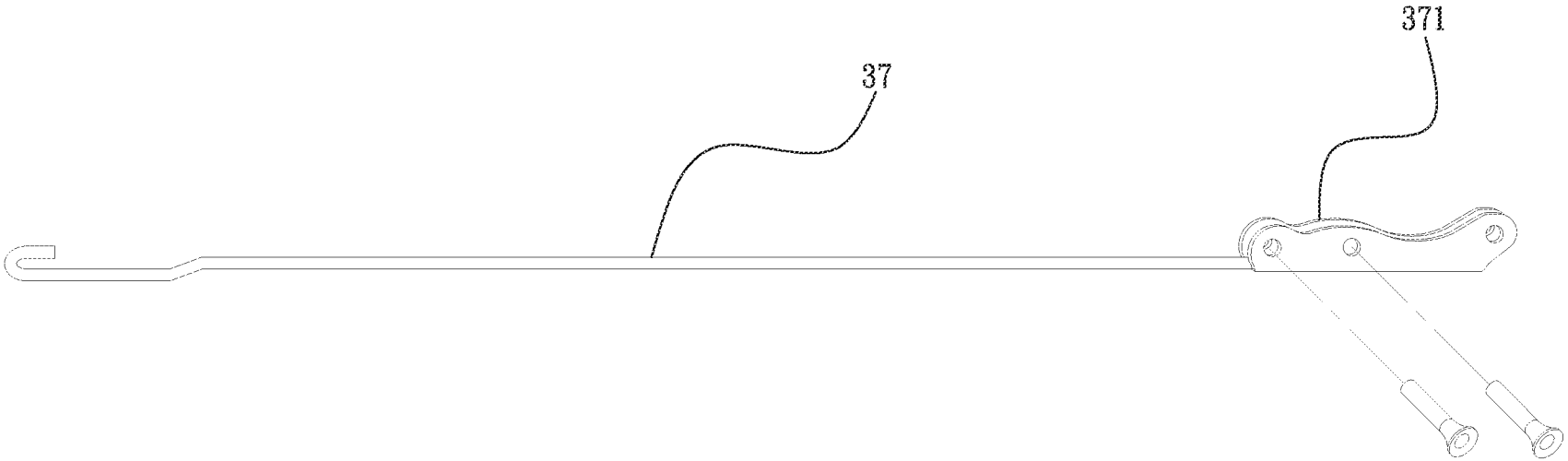
FIG. 5 is an exploded view showing a second middle connecting rib connected with a connecting piece of an embodiment according to the present invention.

The second middle connecting rib 37 and the outer middle connecting rib 38 can be, but not limited, an elastic deformable cylinder. As shown in FIG. 4, a connecting piece 371 is arranged at a connection area between the second middle connecting rib 37 and the outer main rib 33. Refer to FIG. 5, the connecting piece 371 is fixed on the second middle connecting rib 37 by a rivet. The connecting piece 371 is provided with a through hole so that the connecting piece 371 is moveably connected to the outer main rib 33 by connection of a rivet with the through hole, as shown in FIG. 4*b*.

The present special-shaped folding umbrella is provided with the first spring 28, the second middle connecting rib 37, and the second spring 39 for providing connection and linkage between various types of ribs. Thus the present special-shaped folding umbrella 1 can be applied to the field of automatic folding umbrella. Yet the first spring 28, the second middle connecting rib 37, and the second spring 39 are not necessary for the present special-shaped folding umbrella 1. Without these parts, the present special-shaped folding umbrella 1 can still be applied to the field of manual-folding umbrella. That means the present special-shaped folding umbrella 1 is always in the field of folding umbrella and varieties of designs of the special-shaped folding umbrella 1 enhances the competitiveness in the market.

As shown in FIG. 6, the length of the first segment 20*g* of the 3-fold rib 20 and the length of the first segment 30*h* of the 4-fold rib 30 are quite similar (nearly the same). The length of the second segment 20*h* and the length of the third segment 20*i* of the 3-fold rib 20 are respectively quite similar to (almost the same) the length of the third segment 30*j* and the length of the fourth segment 30*k* of the 4-fold rib 30.

A total length of the fourth segment 20*j* and the fifth segment 20*k* of the 3-fold rib 20 is quite similar (approximately equal) to a total length of the fifth segment 30*l* and the sixth segment 30*m* of the 4-fold rib 30, as shown in FIG. 7.

Through the adjustment of the ratio of the length of the respective 3-fold ribs 20 to the length of the respective 4-fold ribs 30, the present special-shaped folding umbrella 1 can be folded quickly and conveniently by the user. Compared with the present device, the umbrellas available now (such as those revealed in CN 202664494 U, CN 201668060 U, CN 201602246 U, and CN 103284424 B) have more complicated cost which causes higher manufacturing cost.

Figure 8:
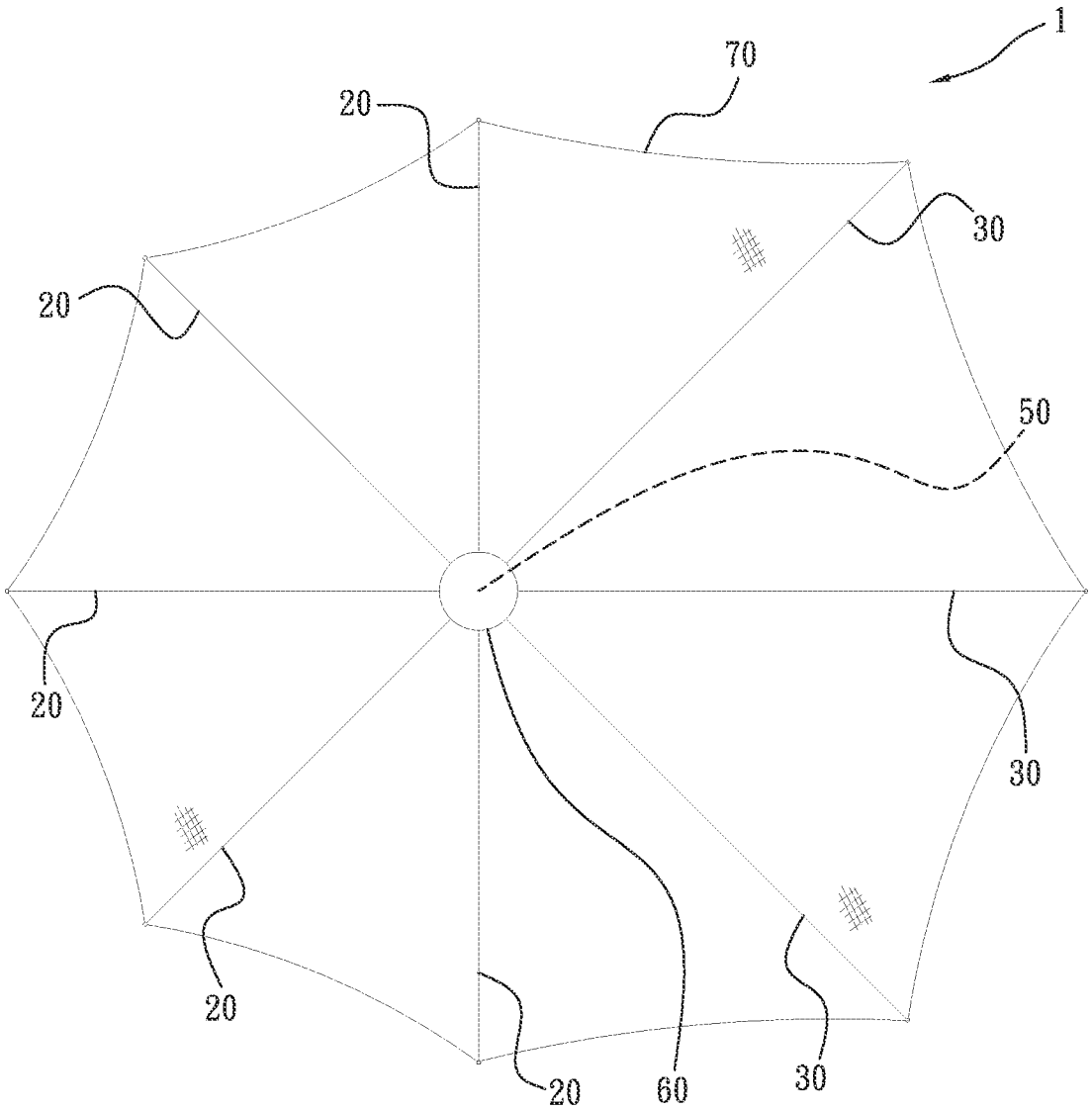
FIG. 8 is a top view of an embodiment provided with five 3-fold ribs and three 4-fold ribs according to the present invention.
Figure 9:
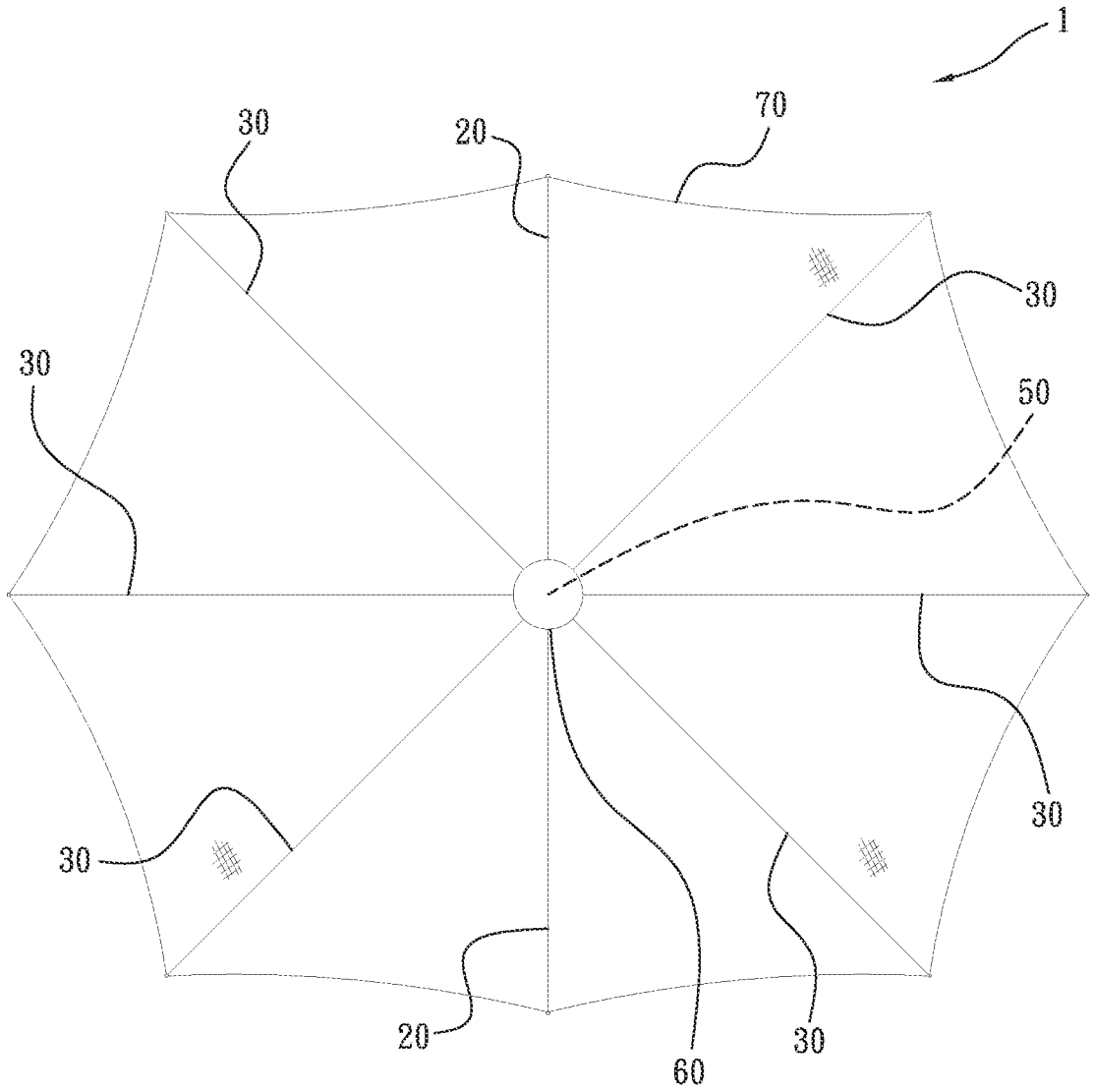
FIG. 9 is a top view of another embodiment provided with two 3-fold ribs and six 4-fold ribs according to the present invention.
Figure 10:
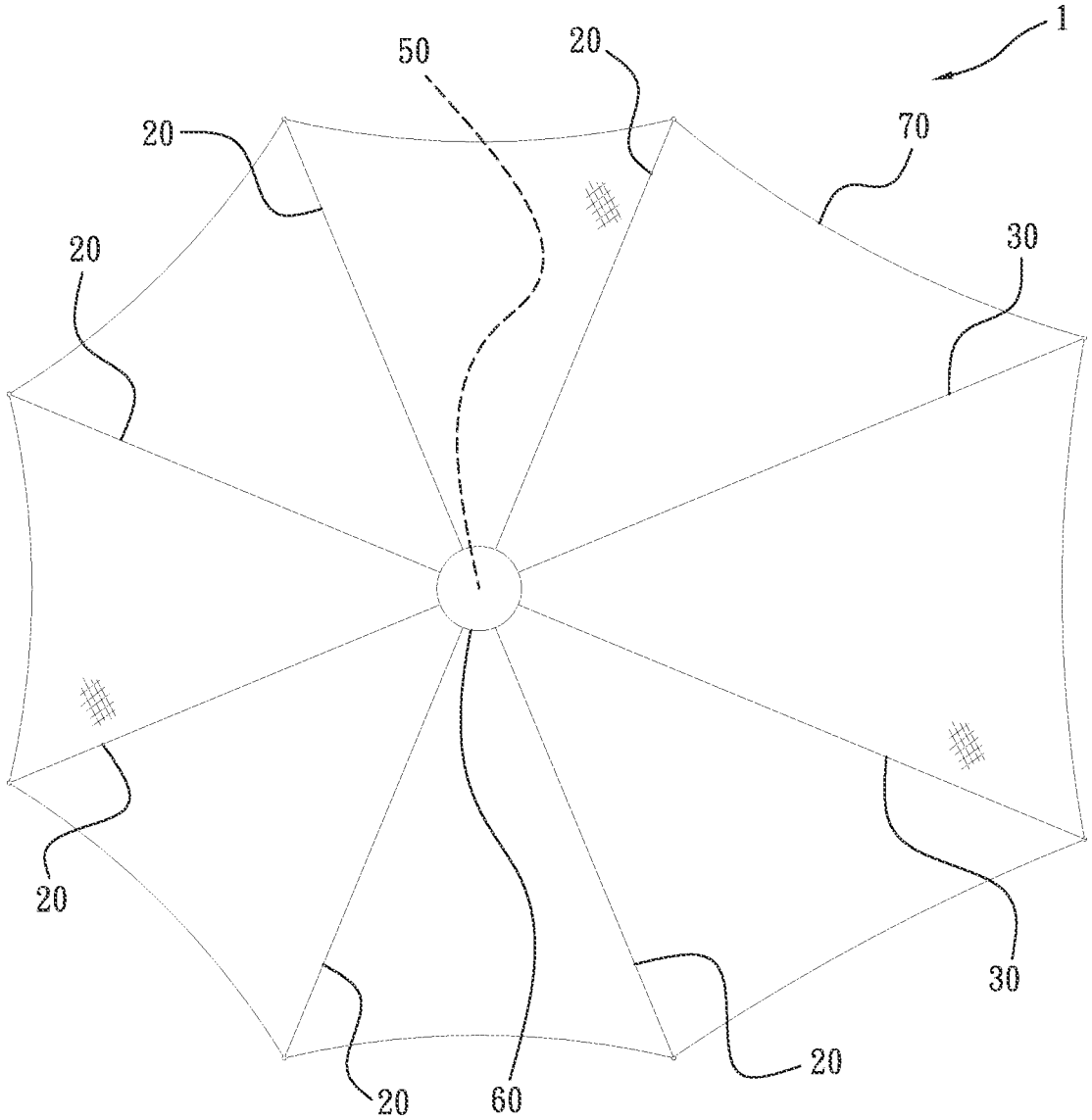
FIG. 10 is a top view of a further embodiment provided with six 3-fold ribs and two 4-fold ribs according to the present invention.

The respective 3-fold ribs 20 and the respective 4-fold ribs 30 are equidistantly arranged around the notch 50, as shown in FIG. 8-10. Refer to FIG. 1, FIG. 2, FIG. 6, and FIG. 7, the respective 3-fold ribs 20 and the respective 4-fold ribs 30 are raised to be opened or folded to be closed for storage synchronously. When the runner 40 is moved and positioned at the position close to the head 14 to hold still, the respective 3-fold ribs 20 and the respective 4-fold ribs 30 are folded to be in a closed state, as shown in FIG. 1 and FIG. 7.

In the folded and closed state, a height of the first connecting point 20*a* of the 3-fold rib 20 and that of the first connecting point 30*a* of the 4-fold rib 30 are quite similar (almost the same), as shown in FIG. 7. A height of the six connecting point 20*f* of the 3-fold rib 20 and that of the seventh connecting point 30*g* of the 4-fold rib 30 are also similar to each other (nearly the same) and so are a height of the third connecting point 20*c* of the 3-fold rib 20 and a height of the fourth connecting point 30*d* of the 4-fold rib 30. Still refer to FIG. 7, the fourth connecting point 20*d* of the 3-fold rib 20 and the fifth connecting point 30*e* of the 4-fold rib 30 have quite similar height (almost the same). Thereby the present special-shaped folding umbrella 1 can be folded up quickly and easily by the user.

Moreover, while in the folded and closed state, the tip 24 of each of the 3-fold ribs 20 and the tip 341 of each of the 4-fold ribs 30 are maintained at the same or quite similar (nearly the same) level, as shown in FIG. 1 and FIG. 7, and such design also helps users to fold up the special-shaped folding umbrella 1 quickly and easily.

The present special-shaped umbrella 1 features on that users can fold up the special-shaped folding umbrella 1 quickly and easily, without using their hands to adjust the positions of the respective ribs or tips. As to the special-shaped folding umbrellas available now (such as one revealed in JP 2020192097 A), the tips of each of the 3-fold ribs and the tips of the each of the 4-fold ribs have different heights. Thus users need to adjust the positions of the respective ribs or the respective tips with their hands for folding up the umbrella.

When the runner 40 is moved upwards and positioned at the position close to the notch 50, the respective 3-fold ribs 20 and the respective 4-fold ribs 30 are in an opened state, as shown in FIG. 2 and FIG. 6. While the respective ribs 20, 30 are in the opened state, a special-shaped canopy 70 of the special-shaped folding umbrella 1 is extended to form a special-shaped surface which is different from a circular surface of typical folding umbrellas, as shown in FIG. 8-10.

According to the numbers of the 3-fold ribs 20 and the 4-fold ribs 30 used and the shape of the special-shaped canopy 70 used in combination with the ribs 20, 30, the special-shaped folding umbrella 1 can be designed into various shapes to meet various users' requirements, as shown in the following embodiments.

In the embodiment shown in FIG. 8, the number of the 3-fold ribs 20 and that of the 4-fold ribs 30 in the special-shaped folding umbrella 1 are respectively five and three. A shaded area of a part of the special-shaped canopy 70 is larger than that of the rest part of the special-shaped canopy 70.

As to the embodiment in FIG. 9, the special-shaped folding umbrella 1 includes two 3-fold ribs 20 and six the 4-fold ribs 30. In the special-shaped canopy 70, there are two areas with larger shaded area than rest areas.

Refer to FIG. 10, the number of the 3-fold ribs 20 and that of the 4-fold ribs 30 in this embodiment of the special-shaped folding umbrella 1 are respectively six and two. Only a part of the special-shaped canopy 70 is having a larger shading area than the rest part of the special-shaped canopy 70.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A special-shaped folding umbrella comprising:

a shaft which is located close to a center of the special-shaped folding umbrella and provided with a head on a bottom of the shaft;

a cap arranged opposite to the head and located on a top of the shaft;

a notch located on the top of the shaft and arranged under the cap;

a runner moveably disposed between the head and the notch;

a plurality of 3-fold ribs which are disposed between the runner and the notch and able to be opened or closed; each of the 3-fold ribs moved along with the runner and having an inner side close to the shaft and an outer side provided with a tip;

a plurality of 4-fold ribs which are disposed between the runner and the notch and able to be opened or closed; each of the 4-fold ribs moved along with the runner and having an inner side close to the shaft and an outer side provided with a tip;

wherein each of the 3-fold ribs includes a first inner main rib having one end moveably connected to the notch, a first middle main rib having one end moveably connected to the other end of the first inner main rib by a rivet, a first outer cylindrical rib having one end moveably connected to the other end of the first middle main rib by a rivet, and the tip connected to the other end of the first outer cylindrical rib; wherein the 3-fold rib further includes a first branched rib having one end moveably connected to the runner and the other end moveably connected to a middle part of the first inner main rib by a rivet, a first inner connecting rib having one end moveably connected to the first branched rib and the other end moveably connected to the first middle main rib, and a first middle connecting rib connected to an outer side of the first inner main rib by a hook; the first middle connecting rib is inserted into the first middle main rib at a position close to an inner side of the first middle main rib, passed through a part of the first middle main rib, and then penetrated out of the first middle main rib at a position close to an outer side of the first middle main rib to be moveably connected to the first outer cylindrical rib; wherein where the first inner main rib is connected to the notch is a first connecting point; wherein where the first inner main rib and the first middle main rib are connected is a second connecting point; wherein where the first middle main rib and the first outer cylindrical rib are connected is a third connecting point; wherein where the first outer cylindrical rib and the tip are connected is a fourth connecting point; wherein where the first branched rib and the middle part of the first inner main rib are connected is a fifth connecting point; wherein where the first branched rib is connected to the runner is a sixth connecting point; wherein the 3-fold rib is composed of a first segment, a second segment, and a third segment arranged from the inner side to the outer side thereof when the 3-fold ribs are opened; a length of the first segment, a length of the second segment, and a length of the third segment are respectively a distance between the first connecting point and the second connecting point, a distance between the second connecting point and the third connecting point, and a distance between the third connecting point and the fourth connecting point; the length of the first segment, the length of the second segment, and the length of the third segment are approximately equal to one another; wherein the 3-fold rib further includes a fourth segment and a fifth segment from the inner side to the outer side thereof when the 3-fold ribs are folded and closed; a length of the fourth segment and a length of the fifth segment are respectively a distance between the first connecting point and the fifth connecting point and a distance between the fifth connecting point and the six connecting point;

wherein each of the 4-fold rib includes a second inner main rib having one end moveably connected to the runner, a second middle main rib having one end moveably connected to the other end of the second inner main rib by a rivet, an outer main rib having one end moveably connected to the other end of the second middle main rib by a rivet, and a second outer cylindrical rib moveably connected to the other end of the outer main rib by a rivet, and the tip arranged at the other end of the second outer cylindrical rib; wherein the 4-fold rib further includes a second branched rib having one end moveably connected to the notch and the other end moveably connected to a middle part of the second inner main rib by a rivet, a second inner connecting rib having one end moveably connected to an upper side of the second branched rib by a rivet and the other end fixed and connected to the second middle main rib by a rivet; wherein an outer side of the second middle main rib is connected to one end of an outer connecting rib by a hook and the other end of the outer connecting rib is moveably connected to one side of the second outer cylindrical rib close to the outer main rib by a rivet; a middle part of the outer main rib is provided with a limit pin which limits the outer connecting rib in the outer main rib; wherein where the second branched rib is connected to the notch is a first connecting point; wherein where the second inner main rib and the second middle main rib are connected is a second connecting point; where the second middle main rib and the outer main rib are connected is a third connecting point; wherein where the outer main rib and the second outer cylindrical rib are connected is a fourth connecting point; wherein where the second outer cylindrical rib and the tip are connected is a fifth connecting point; wherein where the second branched rib and a middle part of the second inner main rib are connected is a sixth connecting point; wherein where the second inner main rib is connected to the runner is a seventh connecting point; wherein when the 4-fold ribs are opened, the 4-fold rib includes a first segment, a second segment, a third segment, and a fourth segment from the inner side to the outer side thereof; a length of the first segment, a length of the second segment, a length of the third segment, and a length of the fourth segment are respectively a distance between the first connecting point and the second connecting point, a distance between the second connecting point and the third connecting point, a distance between the third connecting point and the fourth connecting point, and a distance between the fourth connecting point and the fifth connecting point; the length of the first segment, the length of the second segment, the length of the third segment, and the length of the fourth segment are approximately equal to one another; wherein while the 4-fold ribs are folded and closed, the 4-fold rib further includes a fifth segment and a sixth segment from the inner side to the outer side and both having similar length; a length of the fifth segment and a length of the sixth segment are respectively a distance between the first connecting point and the six connecting point and a distance between the six connecting point and the seventh connecting point;

wherein the length of the first segment of the 3-fold rib and the length of the first segment of the 4-fold rib are similar; wherein the length of the second segment is similar to the length of the third segment of the 4-fold rib; wherein the length of the third segment of the 3-fold rib is similar to the length of the fourth segment of the 4-fold rib;

wherein a total length of the fourth segment and the fifth segment of the 3-fold rib is similar to a total length of the fifth segment and the sixth segment of the 4-fold rib;

wherein the respective 3-fold ribs and the respective 4-fold ribs are equidistantly arranged around the notch;

wherein the respective 3-fold ribs and the respective 4-fold ribs are raised to be opened or folded to be closed for storage synchronously;

wherein the respective 3-fold ribs and the respective 4-fold ribs are folded to be in a closed state when the runner is moved and positioned close to the head to hold still;

wherein in the closed state, a height of the first connecting point of the 3-fold rib and a height of the first connecting point of the 4-fold rib are similar; a height of the six connecting point of the 3-fold rib and a height of the seventh connecting point of the 4-fold rib are similar and so are a height of the third connecting point of the 3-fold rib and a height of the fourth connecting point of the 4-fold rib; a height of the fourth connecting point of the 3-fold rib and the fifth connecting point of the 4-fold rib have similar height; wherein the tip of the 3-fold rib and the tip of the 4-fold rib are maintained at the same or similar height while in the closed state;

wherein the respective 3-fold ribs and the respective 4-fold ribs are in an opened state when the runner is moved upwards and positioned at a position close to the notch;

wherein a special-shaped canopy of the special-shaped folding umbrella is extended to form a special-shaped surface which is different from a circular surface of a typical folding umbrella when the 3-fold ribs and the 4-fold ribs are in the opened state.

2. The special-shaped folding umbrella as claimed in claim 1, wherein the first middle connecting rib is an elastic deformable cylinder.

3. The special-shaped folding umbrella as claimed in claim 1, wherein the outer connecting rib is an elastic deformable cylinder.

4. The special-shaped folding umbrella as claimed in claim 1, wherein the shaft is retractable and composed of an inner tube, a middle tube, and an outer tube while the inner tube is able to be mounted into the middle tube which is able to be mounted into the outer tube; wherein the runner is moveably mounted around the outer tube; wherein the notch and the cap are fixed on a top of the outer tube.

5. The special-shaped folding umbrella as claimed in claim 1, wherein the hook on the first inner main rib is provided with and connected to one end of a first spring while the other end of the first spring is connected to the first inner connecting rib by a lock on one side of the first inner connecting rib.

6. The special-shaped folding umbrella as claimed in claim 1, wherein a lower side of the second inner main rib is connected to one end of a second middle connecting rib by a hook and the other end of the second middle connecting rib is fixed on one side of the outer main rib close to the second middle main rib; a middle part of the second middle main rib is provided with a limit pin which limits the second middle connecting rib in the second middle main rib.

7. The special-shaped folding umbrella as claimed in claim 6, wherein a connecting piece is arranged at a connection area between the second middle connecting rib and the outer main rib and is fixed on the second middle connecting rib by a rivet; the connecting piece is provided with a through hole so that the connecting piece is moveably connected to the outer main rib by connection of a rivet with the through hole.

8. The special-shaped folding umbrella as claimed in claim 6, wherein the second middle connecting rib is an elastic deformable cylinder.

9. The special-shaped folding umbrella as claimed in claim 6, wherein one end of the second inner connecting rib close to the second branched rib is provided with a second spring which is fixed on the hook of the second middle connecting rib.

* * * * *